US007004262B1

(12) United States Patent
Voichoskie et al.

(10) Patent No.: US 7,004,262 B1
(45) Date of Patent: Feb. 28, 2006

(54) ELECTRIC FENCE POST INSTALLER

(76) Inventors: Robert R. Voichoskie, Rte. 1, Box 54, Silver Creek, NE (US) 68663; William J. Kathman, 2105 S. 110th St., Omaha, NE (US) 68144

( * ) Notice: Subject to any disclaimer, the term of this patent is extended or adjusted under 35 U.S.C. 154(b) by 0 days.

(21) Appl. No.: 10/927,597

(22) Filed: Aug. 26, 2004

(51) Int. Cl.
*B21J 7/02* (2006.01)

(52) U.S. Cl. ..... 173/46; 173/28

(58) Field of Classification Search ..... 173/46, 173/28, 85, 24
See application file for complete search history.

(56) References Cited

U.S. PATENT DOCUMENTS

| | | | | |
|---|---|---|---|---|
| 2,565,224 A | | 8/1951 | Gibbens | 255/19 |
| 2,660,035 A | | 11/1953 | Zeiser | 61/73 |
| 3,447,613 A | | 6/1969 | Lisenby | 173/28 |
| 3,507,338 A | | 4/1970 | McWaters et al. | 173/28 |
| 3,576,218 A | | 4/1971 | Lisenby | 173/28 |
| 3,696,625 A | * | 10/1972 | Alexander | 405/303 |
| 3,815,689 A | | 6/1974 | Kuhl | 173/27 |
| 3,934,655 A | * | 1/1976 | Whistle | 173/46 |
| 5,363,925 A | * | 11/1994 | Gallagher | 173/186 |
| 6,517,294 B1 | * | 2/2003 | Vreeland | 405/302.7 |
| 6,591,919 B1 | * | 7/2003 | Herrmann | 173/42 |
| 6,796,747 B1 | * | 9/2004 | Vreeland | 405/302.7 |
| 6,938,703 B1 | * | 9/2005 | Herrmann | 173/42 |

* cited by examiner

*Primary Examiner*—Scott A. Smith
*Assistant Examiner*—Brian Nash
(74) *Attorney, Agent, or Firm*—Thomte, Mazour & Niebergall; Dennis L. Thomte

(57) ABSTRACT

An electric fence post installer comprising a wheeled frame having a first upstanding support extending upwardly therefrom. A generally horizontally disposed boom arm is rotatably mounted on the upper end of the first support and has a carousel support secured to the outer end thereof. A carousel is rotatably mounted, about a vertical axis, on the carousel support and is adapted to have a plurality of vertically disposed and radially spaced-apart electric fence posts supported thereon. A vertically disposed drill is mounted on the carousel support and is adapted to be rotated and moved downwardly with respect to the carousel support to drill a post hole in the ground. After the post hole has been drilled, a fence post is moved from the carousel to a position over the post hole and then is forced downwardly into the post hole. The installer includes means for ensuring that the post hole will be drilled substantially vertically into the ground.

19 Claims, 13 Drawing Sheets

ELECTRIC FENCE POST INSTALLER

BACKGROUND OF THE INVENTION

1. Field of the Invention

This invention relates to an electric fence post installer and more particularly to an apparatus which is pulled behind a truck, ATV, tractor, or the like, and which includes means for drilling a post hole in the ground and then driving an electric fence post downwardly into the post hole. More particularly, this invention relates to a post hole drilling and post-driving machine wherein the electric fence posts are supported on a rotatable carousel in a radially spaced-apart fashion to facilitate the installation of the electric fence posts in the drilled post holes.

2. Description of the Related Art

When a farmer or rancher desires to permit his or her cattle to graze in a harvested cornfield or the like, the farmer drives or inserts electric fence posts into the ground at predetermined intervals and then extends an electric fence wire therebetween which is supported thereon by insulators attached to the fence posts. The problem with the above method is that the task is time-consuming and many times the ground is frozen, which makes it difficult to drive the rods or fence posts into the ground.

Prior art devices have been provided for drilling post holes in the ground and then installing fence posts therein, but the same are extremely complicated and suffer from many disadvantages. It is believed that the prior art devices, while possibly somewhat performing their intended functions on level ground, do not have any mechanisms for ensuring that the post holes will be drilled into the ground in a perfectly plumb fashion so that the fence posts installed therein will also be plumb or perfectly vertically disposed. Further, it is not believed that the prior art devices provide a carousel or magazine wherein a plurality of fence posts is positioned therein in a radially spaced-apart fashion to facilitate the rapid installation of fence posts into the ground.

SUMMARY OF THE INVENTION

The electric fence post installer of this invention comprises a wheeled frame means having a forward end, a rearward end, and first and second sides. The wheeled frame means is pulled behind a truck, ATV, tractor, or other prime mover. A vertically disposed support member, having upper and lower ends, is secured at its lower end to the wheeled frame and has a horizontally disposed boom arm selectively rotatably secured to the upper end thereof which has inner and outer ends. The boom arm is selectively rotatably movably positioned with respect to the support member so that the boom arm may be moved from a transport position adjacent the wheeled frame means to an operative position outwardly of the wheeled frame means. The apparatus includes a first brake which selectively locks the boom arm in selected positions with respect to the support member. A pivot yoke is pivotally secured to the outer end of the boom arm about a horizontal axis and a vertical axis. A carousel support is selectively vertically movably secured to the pivot yoke and a vertically disposed carousel is selectively rotatably mounted on the carousel support. The apparatus of this invention also includes second and third brakes which selectively lock the carousel in a vertically disposed position or plumb condition prior to drilling a post hole or driving a fence post into the post hole. The carousel supports a plurality of vertically disposed electric fence posts thereon in a radially spaced-apart manner. The apparatus includes an indexing means for selectively rotating the carousel to properly sequentially place the fence posts into a placement position. The fence posts are selectively movable between pick-up and placement positions on the carousel. A drill support is mounted on the carousel support and is selectively pivotally movable between drilling and non-drilling positions with respect to the carousel support. A vertically disposed rotatable drill is selectively vertically and rotatably movably mounted on the carousel support and may be moved downwardly with respect to the carousel support to drill a post hole in the ground when the drill support is in its drilling position. The drill support, when in its drilling position, enables the drill to drill the post hole in the ground laterally of the carousel. A drive/install mechanism is mounted on the carousel with the drive/install mechanism adapted to selectively drive a post from its placement position on the carousel downwardly into the post hole created by the drill when the drill has been moved from its drilling position to its non-drilling position.

It is therefore a principal object of the invention to provide an improved electric fence post installer.

A further object of the invention is to provide an electric fence post installer which is pulled or towed behind a prime mover such as a truck, ATV, tractor, or the like.

Yet another object of the invention is to provide an electric fence post installer which positions the fence post in the ground in a substantially vertically disposed position regardless of whether the ground is level or uneven.

Still another object of the invention is to provide an electric fence post installer which drills a post hole and which drives a fence post therein with a drill/install mechanism.

Still another object of the invention is to provide an electric fence post installer which is convenient to use.

Yet another object of the invention is to provide an electric fence post installer which permits the installation of a fence post into frozen ground.

Yet another object of the invention is to provide an electric fence post installer of the type described wherein the installer includes a post hole digger to enable the fence post to be driven into the ground therein.

Still another object of the invention is to provide an electric fence post installer which is easily transported from field location to field location.

Still another object of the invention is to provide an electric fence post installer of the type described including means for supporting a plurality of fence posts on a carousel in a radially spaced-apart condition so that the post installation process is rapidly achieved.

These and other objects will be apparent to those skilled in the art.

DETAILED DESCRIPTION OF THE INVENTION

Figure 1:
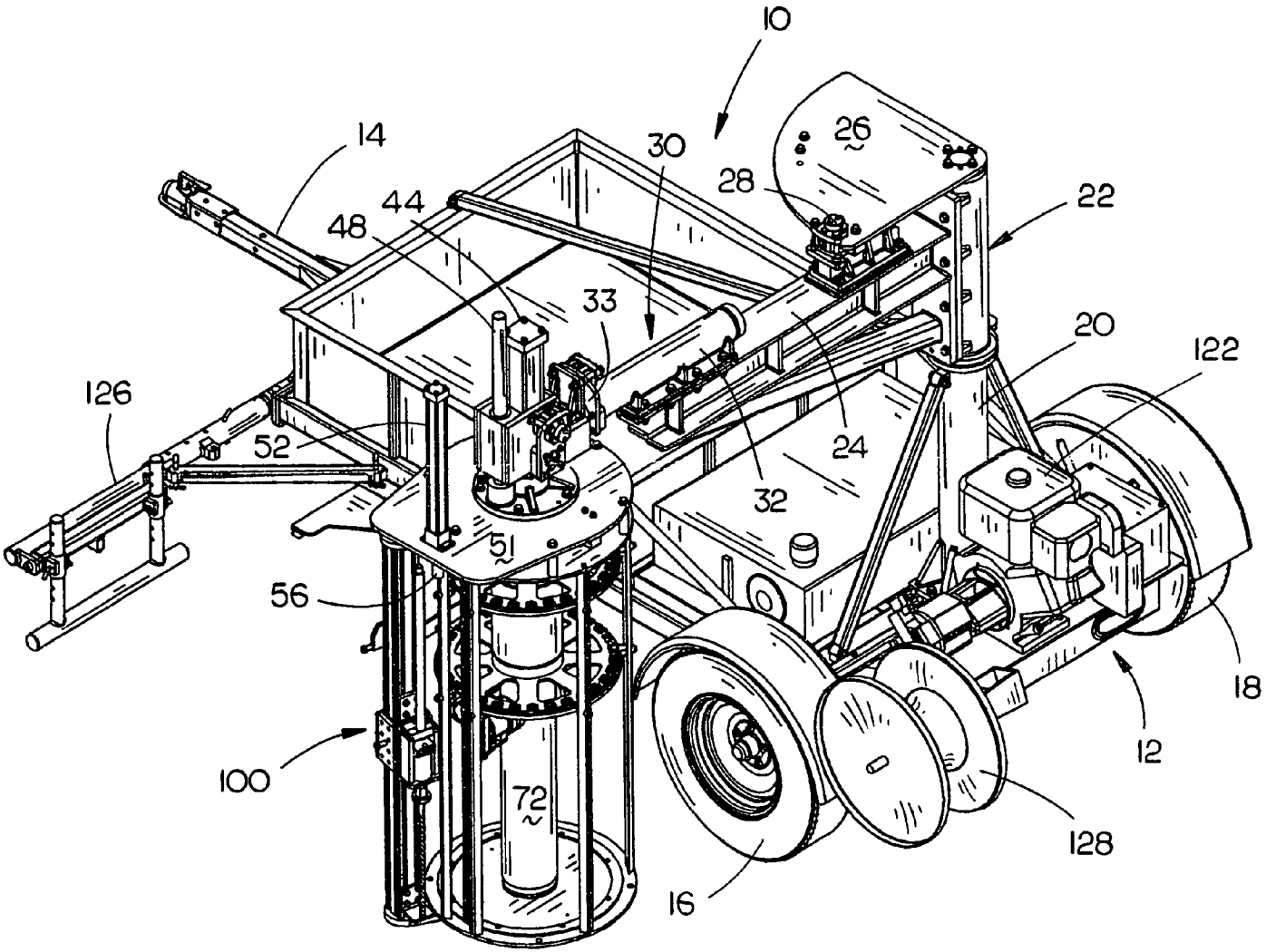
FIG. 1 is a rear perspective view of the electric fence post installer of this invention.
Figure 2:
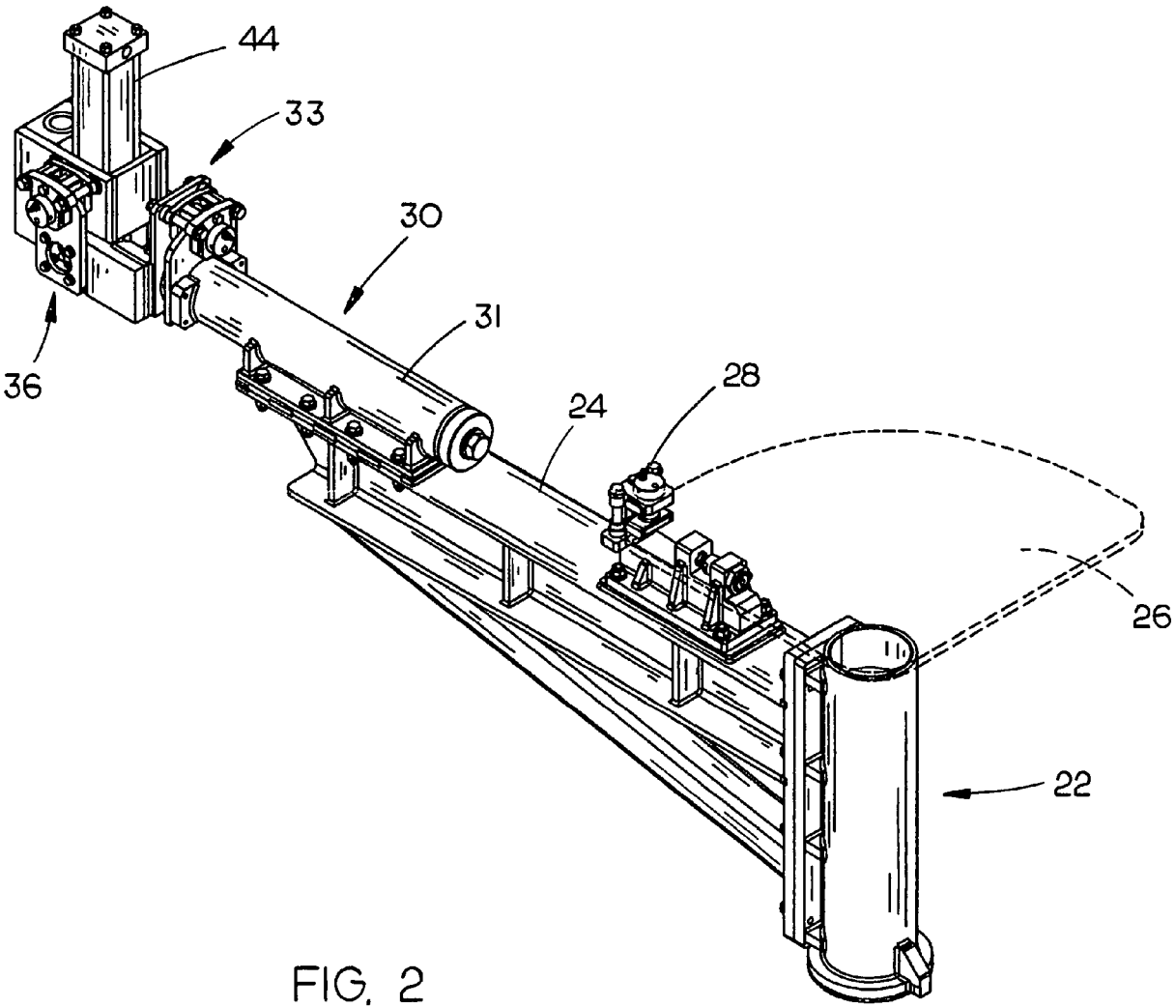
FIG. 2 is a perspective view of the boom arm pivot and carousel pivot assembly.
Figure 3:
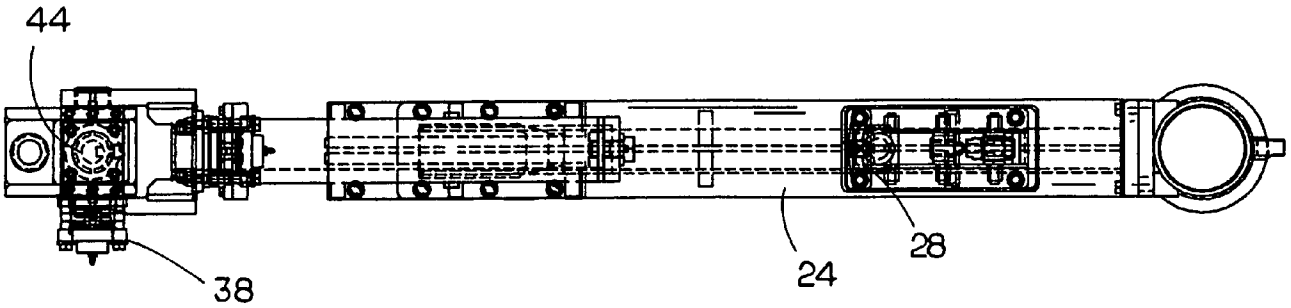
FIG. 3 is a top elevational view of the boom arm pivot and carousel pivot assembly.
Figure 4:
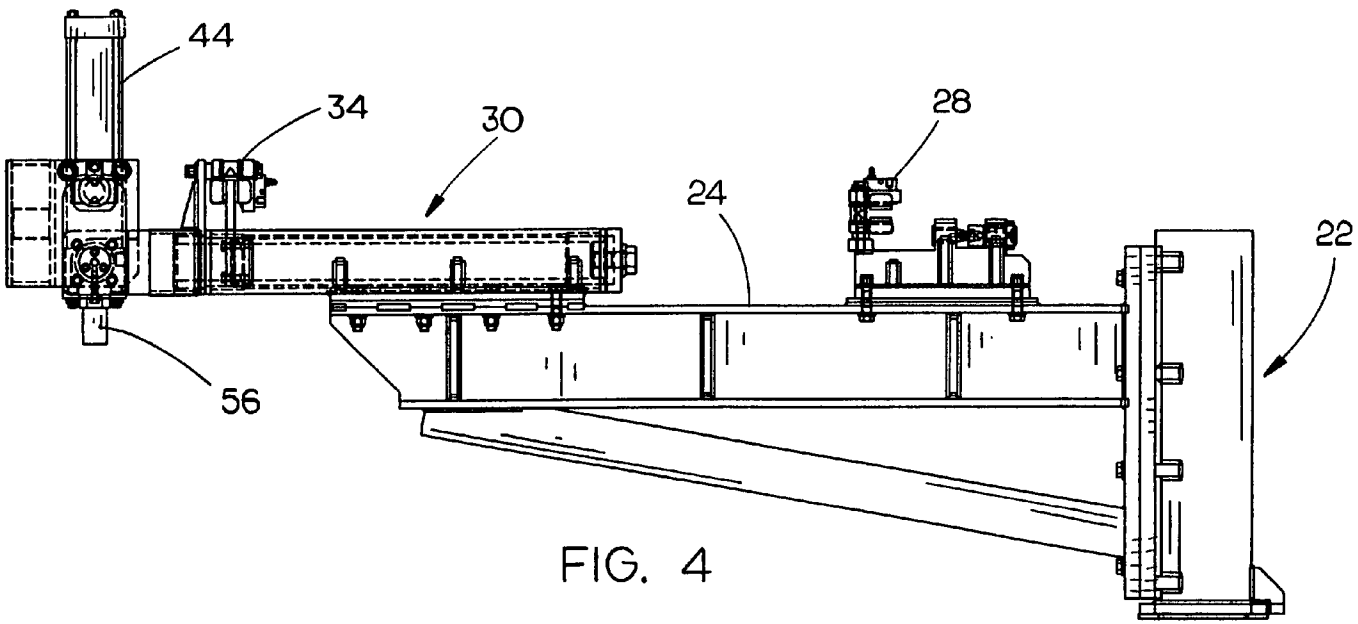
FIG. 4 is a side elevational view of the boom arm pivot and carousel pivot assembly.
Figure 5:
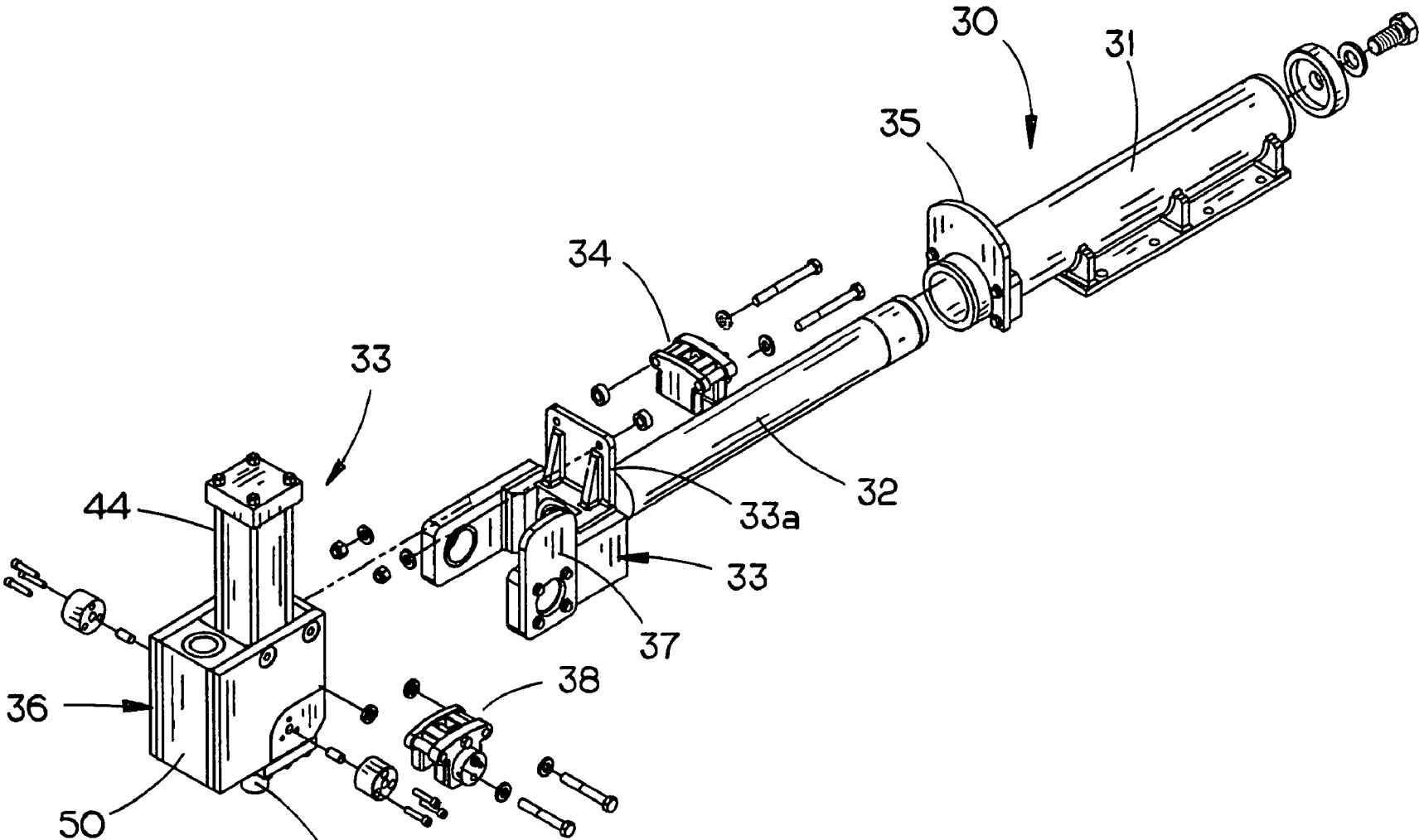
FIG. 5 is an exploded perspective view of the carousel pivot assembly.
Figure 6:
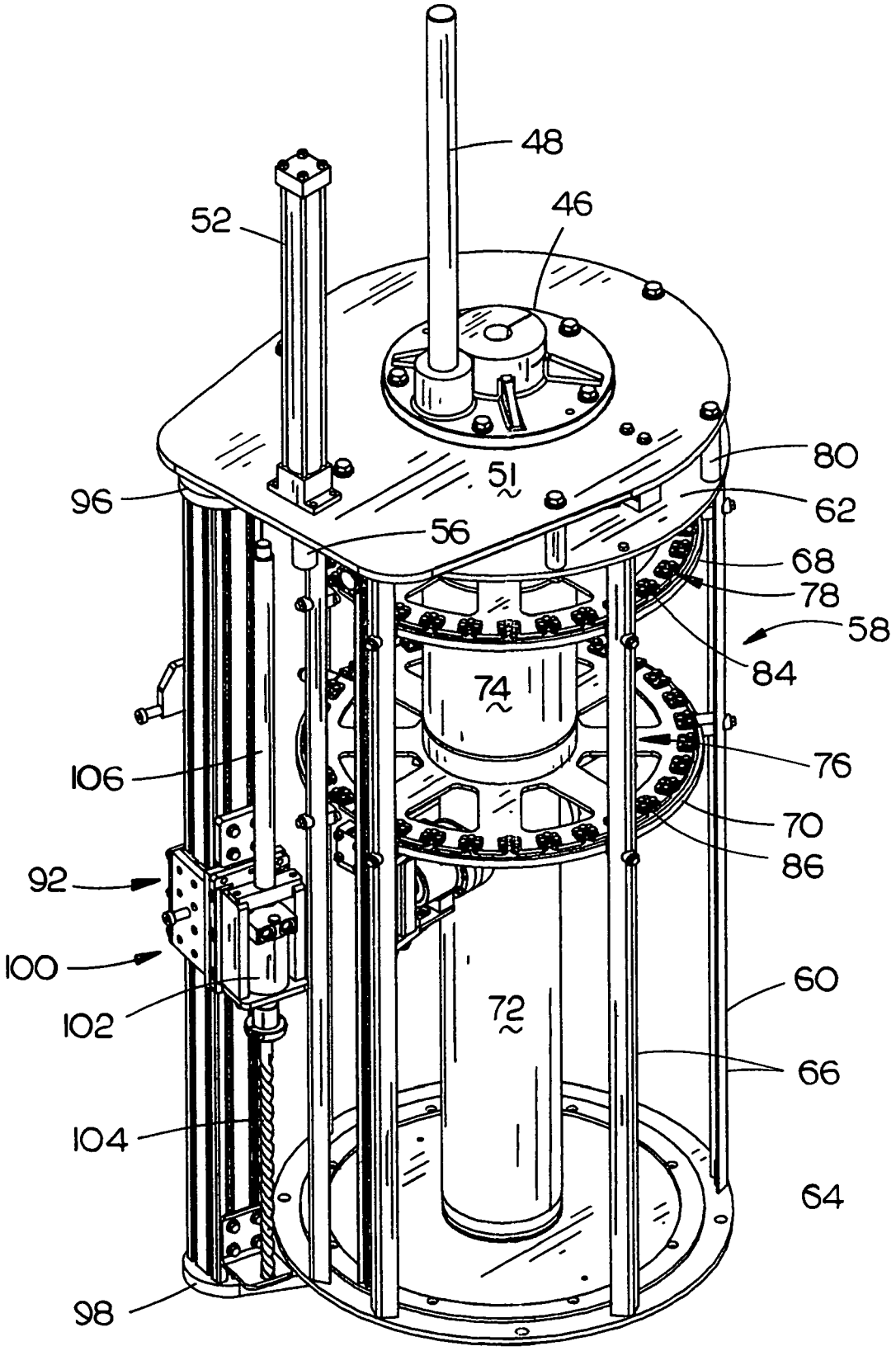
FIG. 6 is a perspective view of the carousel of this invention.
Figure 7:
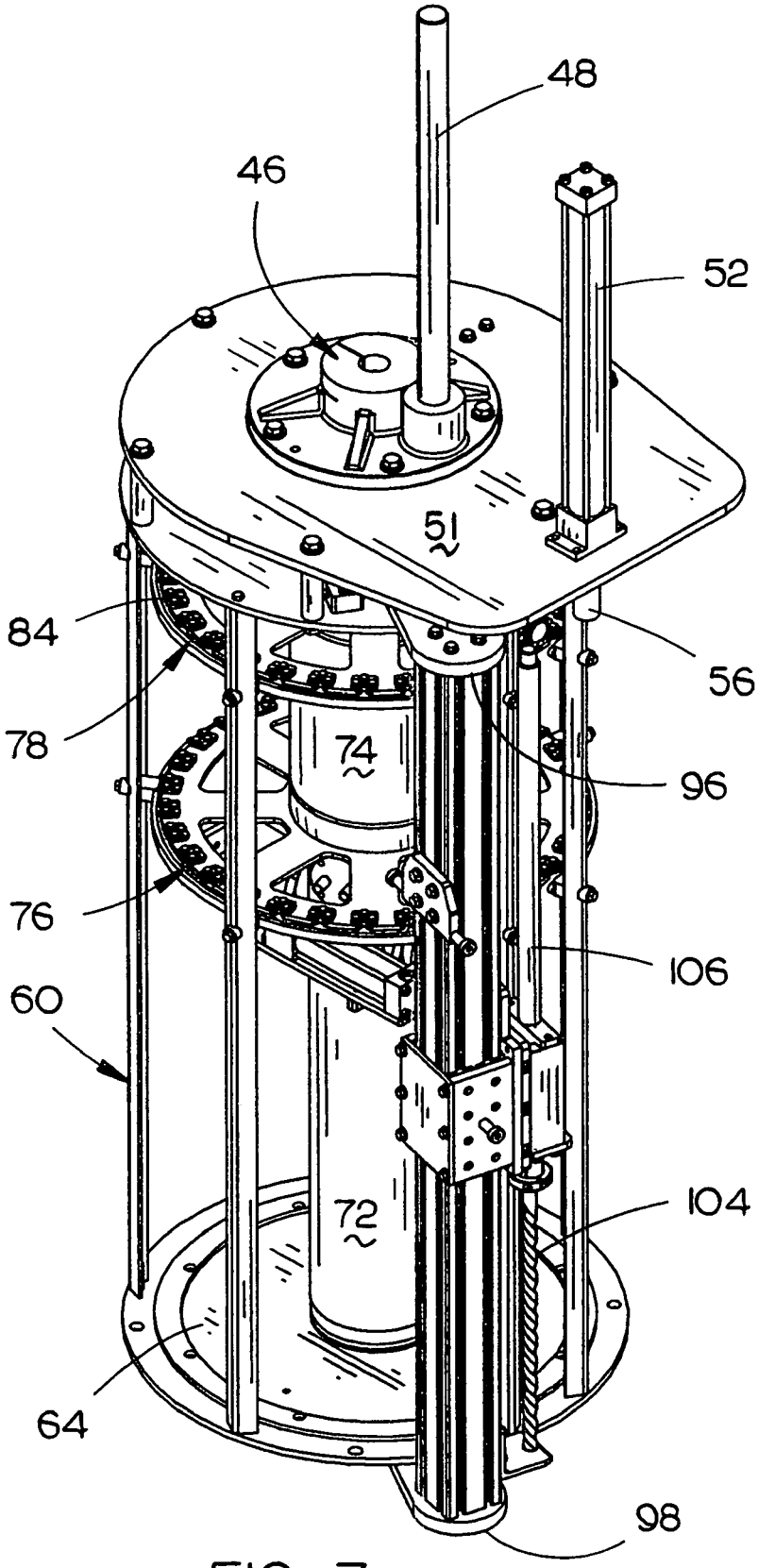
FIG. 7 is a perspective view of the carousel of this invention.
Figure 8:
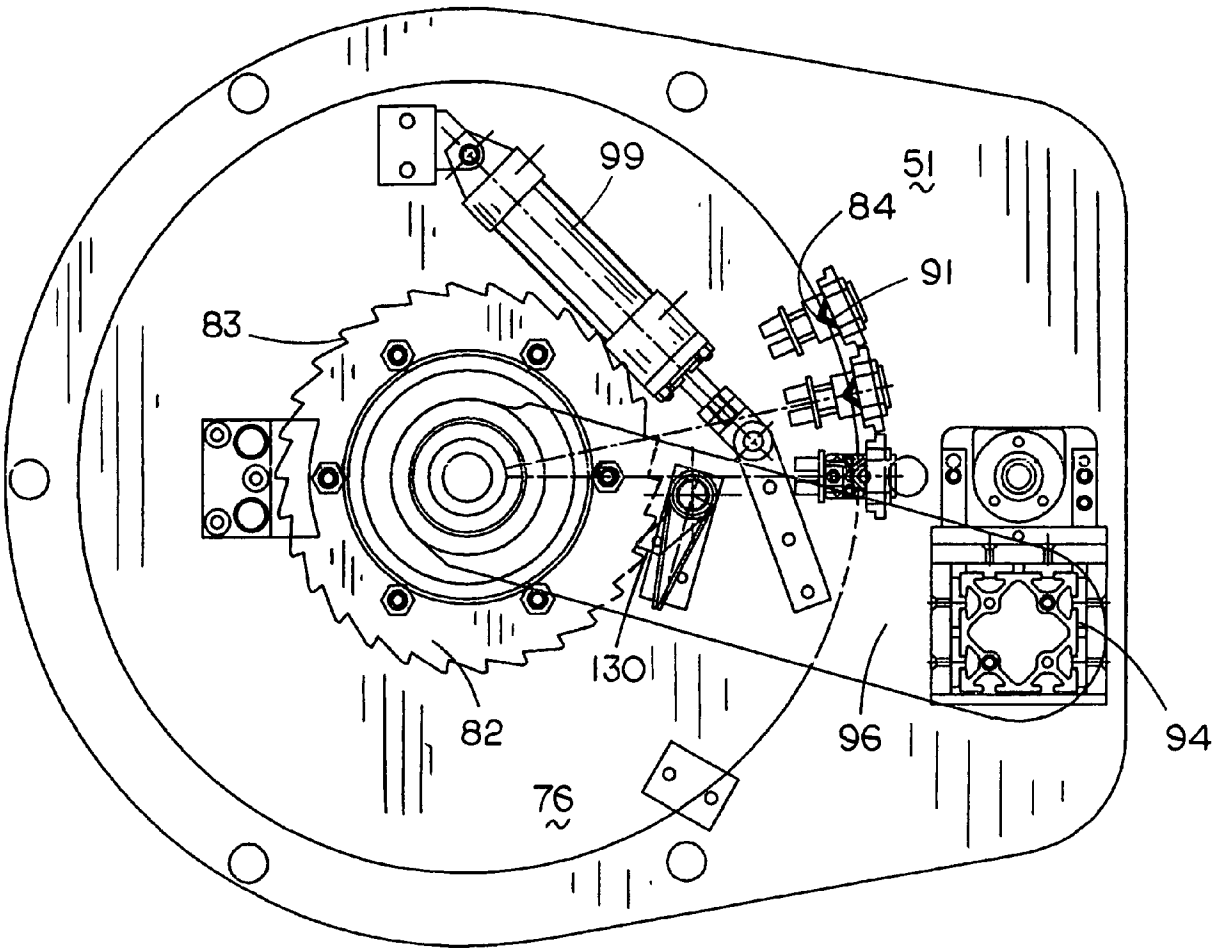
FIG. 8 is a top elevational view of the carousel indexing apparatus of this invention.
Figure 9:
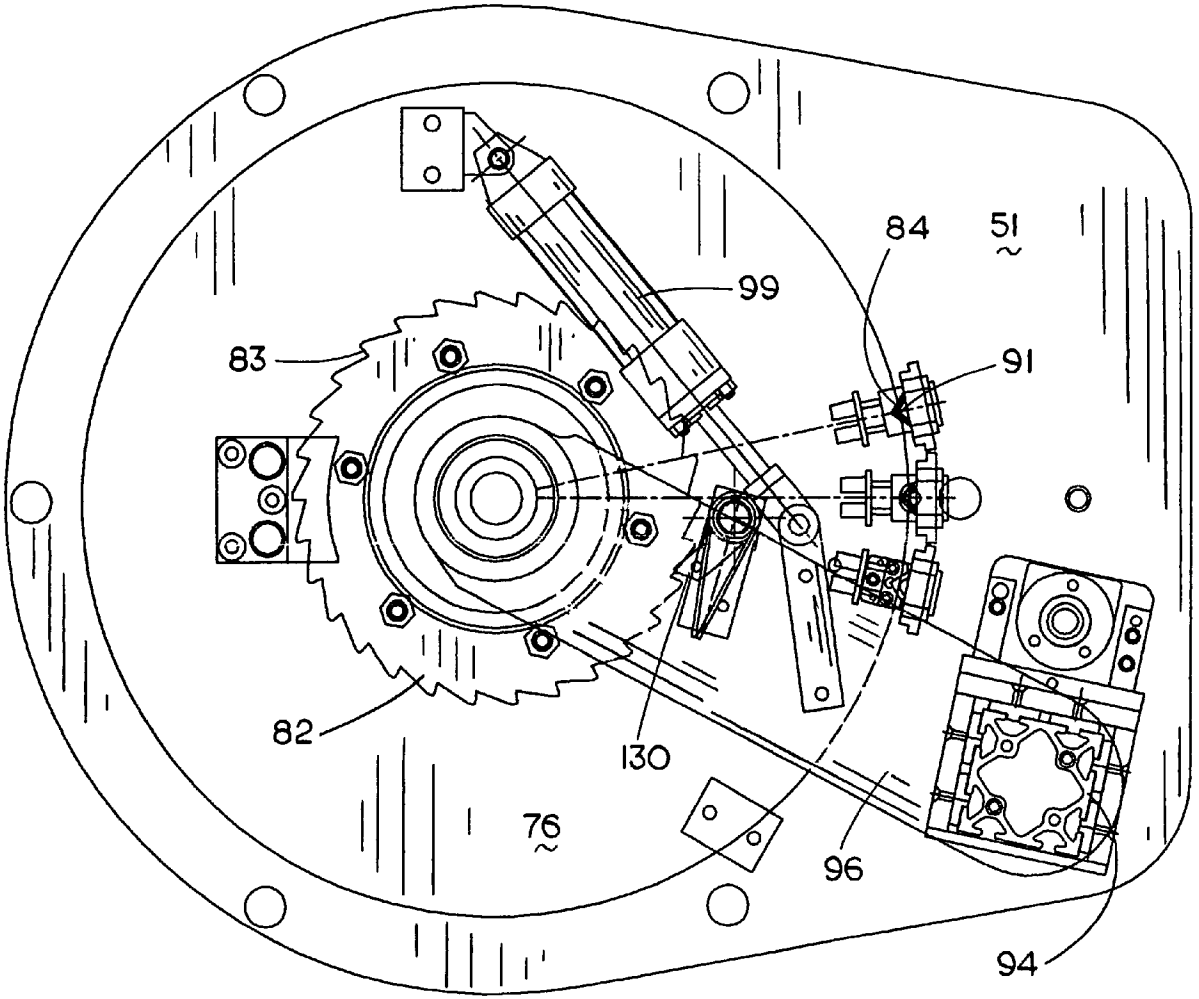
FIG. 9 is a view similar to FIG. 8 except that the carousel has been indexed from the position of FIG. 8.
Figure 10:
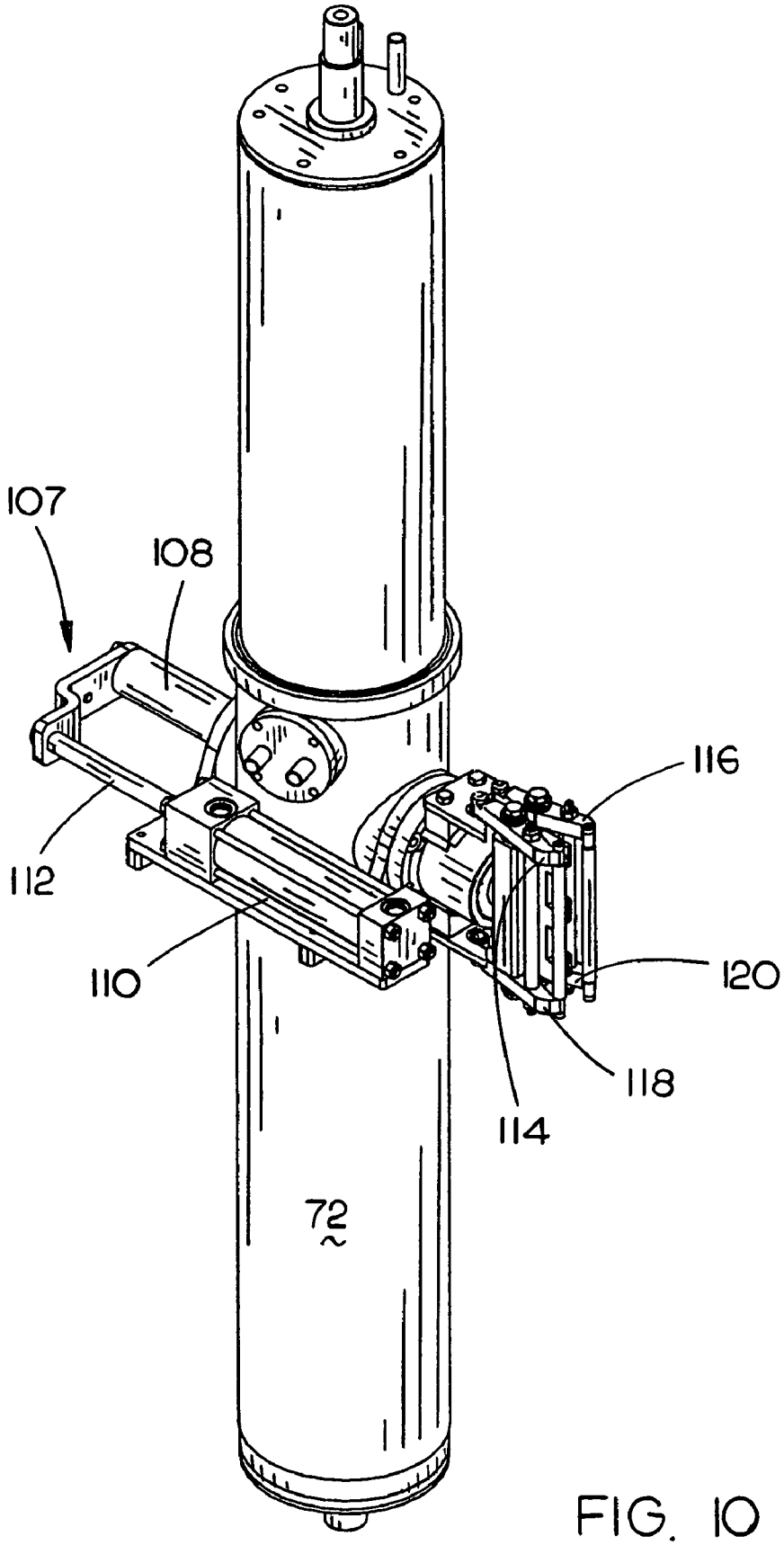
FIG. 10 is a perspective view of the central post of the carousel and the post placement mechanism.
Figure 11:
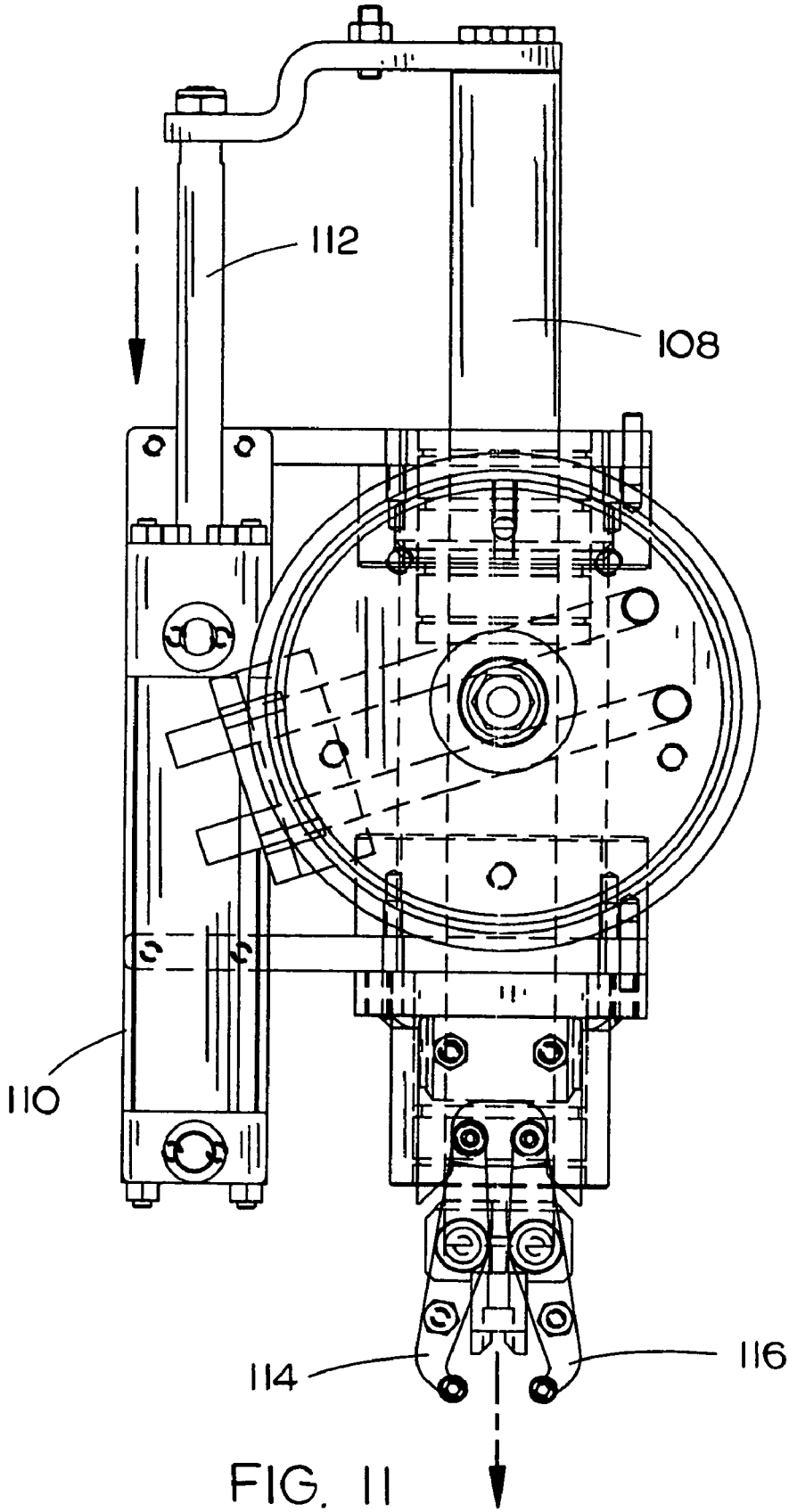
FIG. 11 is a top view of the post placement assembly illustrating the manner in which the post placement assembly is moved from its rest position to its placement position.
Figure 12:
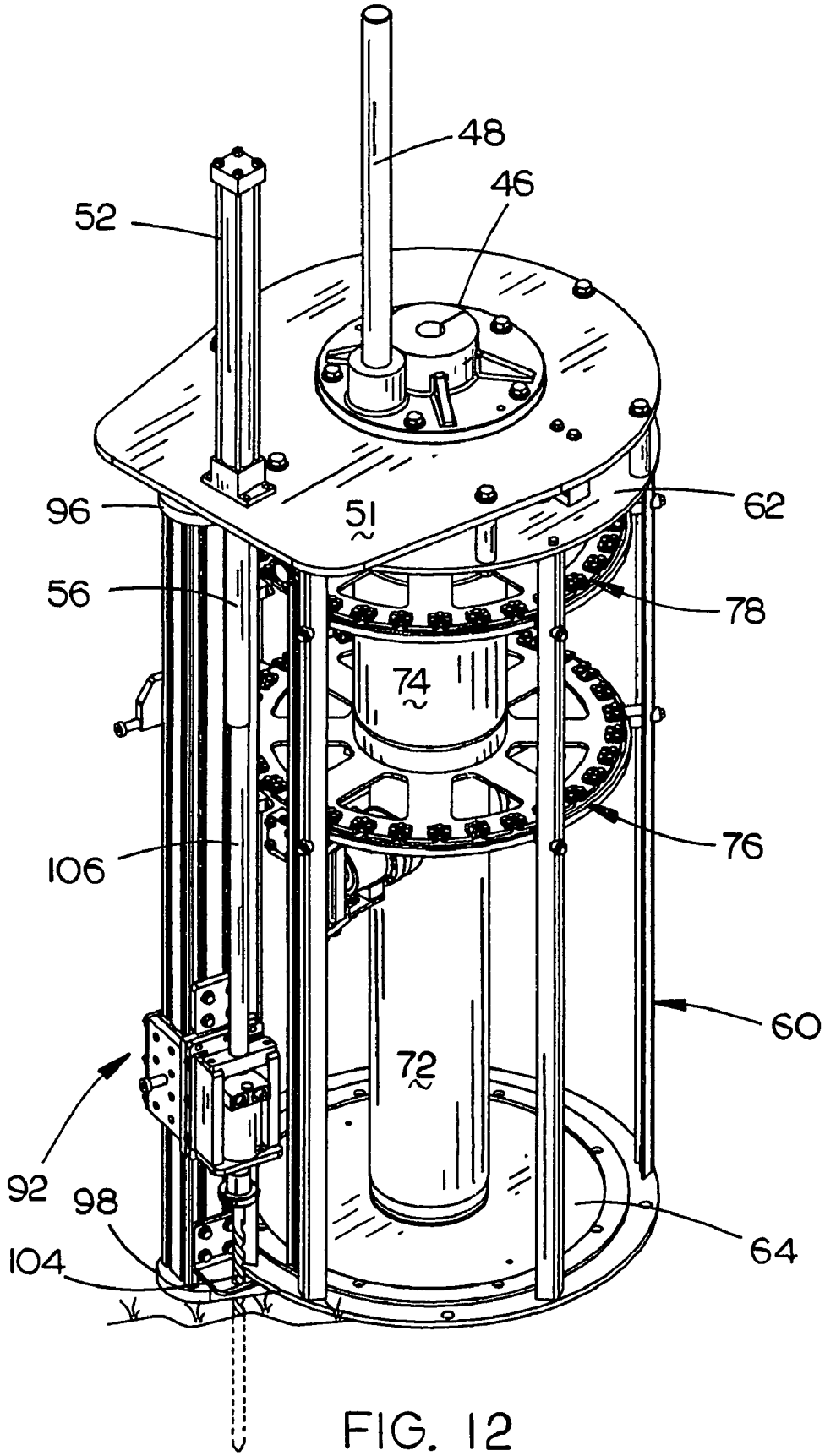
FIG. 12 is a perspective view of the carousel illustrating the drilling of the post hole.
Figure 13:
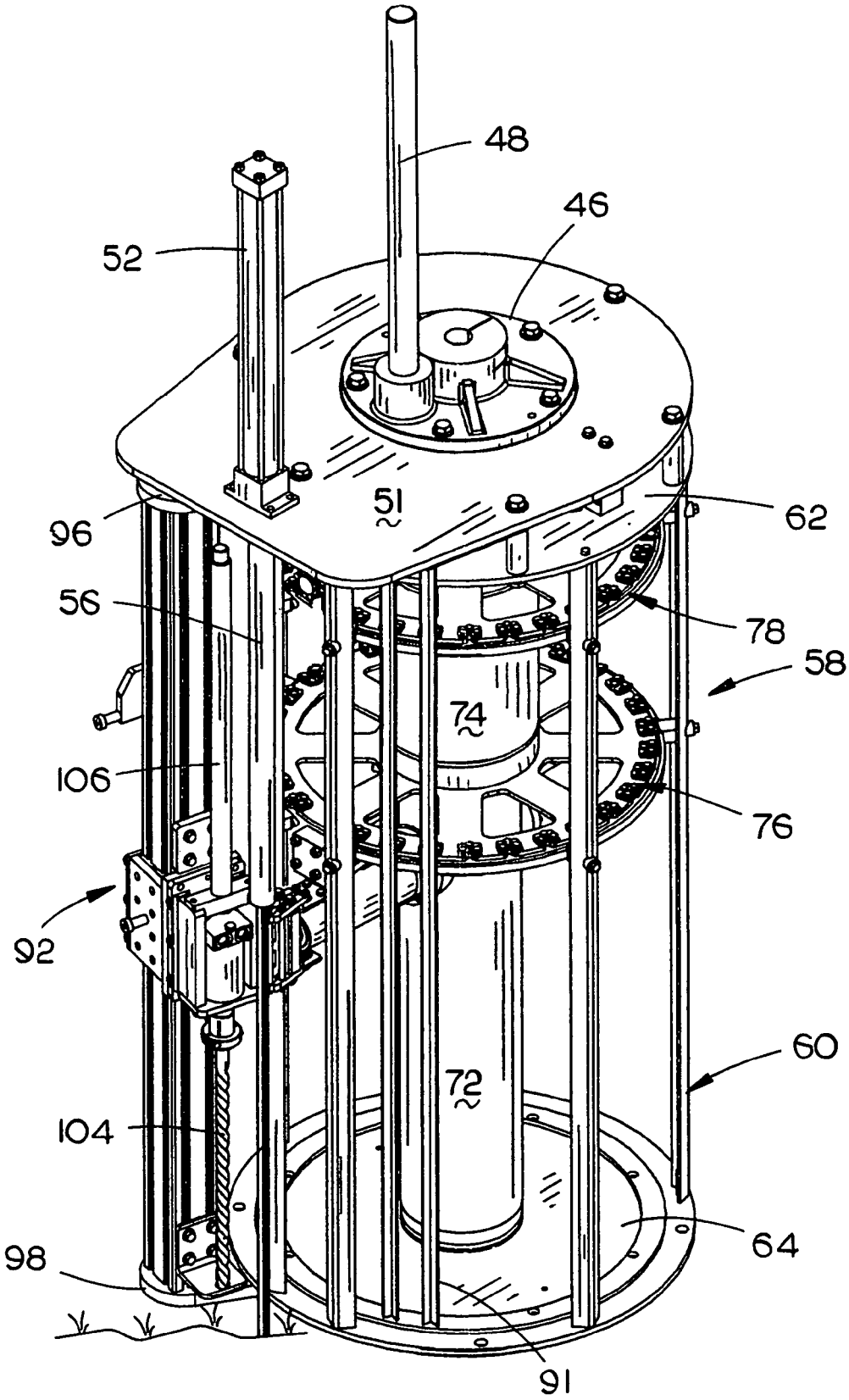
FIG. 13 is a perspective view of the carousel illustrating the placement of the fence post in the post hole.

The electric fence post installer of this invention is referred to generally by the reference numeral 10 and is comprised of a wheeled frame means 12 which is adapted to be pulled or towed behind a prime mover such as a pickup truck, truck, ATV, tractor, or the like. The design of the installer 10 is such that it is easily moved from field location to field location and when used in a field, is stable and convenient to use. Wheeled frame means 12 includes a rear axle having wheels 16 and 18 mounted thereon. The forward end of wheeled frame means 12 includes a conventional hitch or tongue 14 thereon for connection to the prime mover. The numeral 20 refers to an upstanding support member which has its lower end secured to the wheeled frame means 12 and which has a tubular boom arm pivot 22 rotatably mounted on the upper end thereof. Boom arm pivot 22 may be manually rotated with respect to member 20 or may be rotated with respect thereto by a gear motor, hydraulic cylinder, etc. A horizontally extending boom arm 24 is secured to boom arm pivot 22 for rotation therewith, as seen in the drawings. Plate 26 is rigidly fixed to the upper end of support member 20 so that boom arm pivot 22 and boom arm 24 may rotate with respect thereto about a vertical axis. Boom arm 24 carries a brake means of the caliper type which is referred to generally by the reference numeral 28 and which is adapted to engage the periphery of the plate 26 to lock the boom arm 24 in various rotatable positions with respect to the support member 20 and plate 26.

The numeral 30 refers to a carousel pivot assembly including a tubular member 31 which is secured to the outer end of boom arm 24. A tube 32 is rotatably mounted in tubular member 31 and has a pivot yoke 33 secured to its outer end thereof for rotatable movement therewith. Pivot yoke 33 includes an upstanding plate 33*a* secured thereto which supports a caliper disc brake means 34 thereon which is adapted to selectively clamp onto plate 35, which is secured to tubular member 31, to lock the pivot yoke 33 in position with respect to tubular member 31. Lift cylinder housing 36 is pivotally secured to the outer end of pivot yoke 33 about a horizontal axis which is transverse to tubular member 31. Pivot yoke 33 has an upstanding plate 37 secured thereto at one side thereof which is received within the caliper disc brake 38, which is mounted on lift cylinder housing 36, to selectively lock the lift cylinder housing 36 in position with respect to pivot yoke 33. The brakes 34 and 38, when released, permit the carousel, which will be described hereinafter, to hang in a plumb position regardless of the attitude of support member 20 and boom arm 24.

Lift cylinder housing 36 also has a hydraulic lift cylinder 44 mounted thereon with the cylinder rod thereof being connected to carousel support 46. Guide rod 48 extends upwardly from carousel support 46 through a guide block 50 on lift cylinder housing 36. The carousel support 46 has a horizontally disposed plate 51 secured thereto, as seen in the drawings. A hydraulically operated drill/install cylinder 52 is also mounted on carousel support 46 and has its cylinder rod extending downwardly therethrough. The lower end of the cylinder rod of cylinder 52 has a hollow fitting or sleeve 56 secured thereto.

The numeral 58 refers generally to a fence post supporting carousel assembly which includes a carousel frame 60. Frame 60 includes a carousel frame top plate 62 which is secured to plate 46 by stand-off bolts 80 and which is spaced therebelow. Carousel frame 60 also includes a carousel frame bottom plate 64 which is connected to top plate 62 by a plurality of radially spaced-apart tie bars 66. A pair of vertically spaced and horizontally disposed rails 68 and 70 are secured to tie bars 66. The upper ends of the tie bars 66 are bolted to top plate 62 while the lower ends of the tie bars 66 are bolted to bottom plate 64. It is important to note that the carousel frame 60 does not rotate.

The numeral 72 refers to a center column which has its lower end bolted or otherwise secured to bottom plate 64 and which has its upper end bolted or otherwise secured to top plate 62. Tube 74 is rotatably mounted on center column 72 and has a carousel bottom plate 76 secured to its lower end and a carousel top plate 78 secured to its upper end for rotation therewith. Plates 76 and 78 are rotatably mounted within the rails 68 and 70, respectively.

Figure 14:
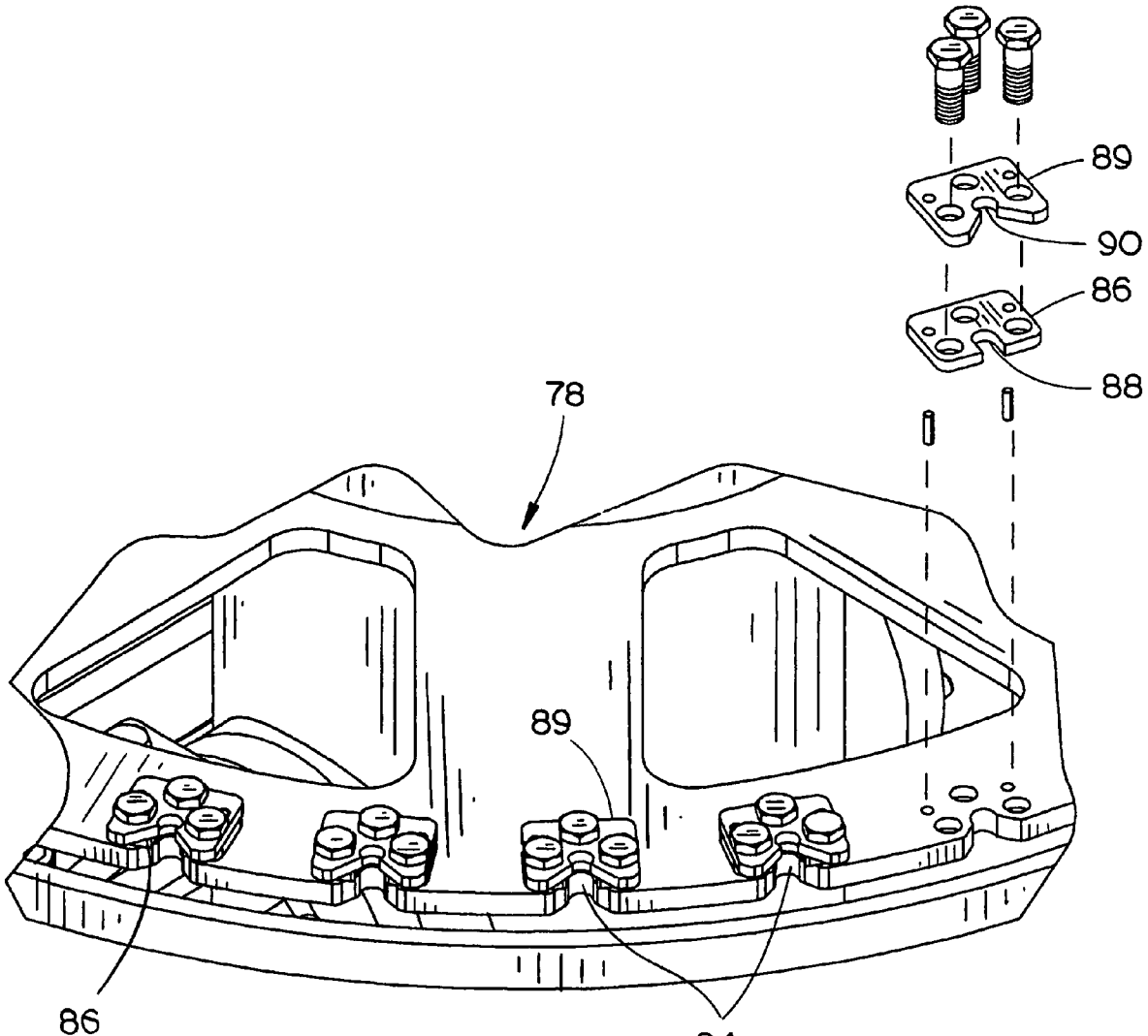
FIG. 14 is a partial perspective view of the carousel upper plate.

Ratchet plate 82 is secured to plate 76 and includes ratchet teeth 83. Plates 76 and 78 each have a plurality of radially spaced-apart, generally V-shaped or U-shaped chuck notches 84 formed thereon (FIG. 14). A magnet 86 having a U-shaped notch 88 formed therein is positioned over each of the notches 84 and a chuck plate 89 having a notch 90 formed therein is positioned over each of the magnets 88 (FIG. 14). The magnets 88 magnetically hold the L-shaped or V-shaped fence posts 91 in the chuck notches 84.

The numeral 92 refers to a post drill assembly which includes a vertically disposed drill guide column 94 which has flat plates 96 and 98 secured to the upper and lower ends thereof, respectively. Plate 96 is secured at its upper end to plate 76 and ratchet plate 82. The post drill assembly 92 is movable between a rest (non-drilling) position to an operative (drilling) position by means of the hydraulic cylinder 99 connected thereto. A drill head 100 is vertically movably mounted on drill guide column 94 and includes a hydraulic motor 102 which is adapted to rotate drill or drill bit 104 operatively connected thereto. Drill drive rod 106 extends upwardly from drill head 100, the upper end of which is positioned directly below fitting 56 on the cylinder rod of drill/install cylinder 52 when the post drill assembly 92 is in its operative (drilling) position. The rod of cylinder 52, upon extension from drill/install cylinder 52, moves drill 104 downwardly, as hydraulic motor 102 rotates drill bit 104, to create a post hole into which a fence post will be driven. When the post drill assembly 92 is in its rest or non-drilling position, the fitting 56 will be above the fence post to be driven into the post hole so that extension of the rod from drill/install cylinder 52 will drive the fence post downwardly into the post hole.

The post placement portion of this invention is referred to generally by the reference numeral 107 and includes a slide shaft 108 which is selectively horizontally movably mounted in center column 72 between post pick-up and post placement positions. Shaft 108 is moved by hydraulic cylinder 110, as seen in the drawings. Extension of rod 112 from cylinder 110 moves slide shaft 108 to its pick-up position and retraction of rod 112 from cylinder 110 moves slide shaft 108 to its post placement position. A pair of post clamp arms 114 and 116 are pivotally mounted on the inner upper end of slide shaft 108 and a pair of lower post clamp arms 118 and 120 are pivotally mounted on the inner lower end of slide shaft 108. The clamp arms 114, 116, 118 and 120 are movable between open (non-clamping) and closed (clamping) positions. When slide shaft 108 is in its pick-up position, the clamp arms 114, 116, 118 and 120 are in their open position so that the fence post 91 may be received therein. As rod 112 is retracted so that the clamp arms 114, 116, 118 and 120 move towards the fence post 91 held in position by the magnets on plates 76 and 78, the clamp arms automatically close around the fence post 91 to firmly grasp the same to push the fence post from the plates 76 and 78 to a position directly below the fitting or sleeve 56 of the drill/install cylinder 52. Extension of the rod from the drill/install cylinder 52 causes the fitting 56 to engage the upper end of the fence post 91 so as to drive the fence post 91 downwardly into the post hole just created by the drill 104.

The installer 10 is also provided with an internal combustion engine 122 mounted on the wheeled frame 12 which powers a conventional hydraulic pump to supply hydraulic fluid under pressure to the hydraulic cylinders 44, 52 and 110, the hydraulic motor 102, as well as the caliper brakes 28, 34 and 38 through conventional circuitry and controls therefore.

The installer 10 is also preferably provided with a storage box 124 for carrying the fence posts therein prior to the same being mounted on the carousel. Additionally, it is preferred that a stalk knocker apparatus 126 be secured to the frame means 12 forwardly of the carousel, when the carousel is in its operative position, to flatten cornstalks which are in the path of the carousel when the installer is being moved through the cornfield. Further, it is preferred that a fence wire reel 128 be mounted on the installer 10 so that the electric fence wire may be unreeled therefrom and secured to the insulators on the installed fence posts.

The installer 10 is operated as follows. The installer 10 is pulled to the desired location where the fence posts are to be installed with the boom arm 24 in its inoperative or stored position which closely positions the carousel 58 adjacent the left side of the frame means 12 to narrow the width of the installer 10 for transport purposes. The stalk knocker apparatus 126, if such is included on the installer 10, will have been removed from the frame means 12 and placed within the box 124. The brakes 28, 34 and 38 will be in their closed or "braking" positions. Hydraulic cylinders 44 and 52 will be in their retracted positions and the post drill assembly 92 will normally be in its non-drilling position during transport of the installer from one field location to another.

When the installer 10 has been pulled to the field location where the fence posts are to be installed, the brake 28 is released to permit boom arm 24 to be manually pivotally moved down away from frame means 12 to its work or operative position. If the fence posts have not previously been mounted on the carousel 58, they will be mounted thereon at this time with the magnets 86 holding the posts in place on the carousel 58.

The brakes 34 and 38 are then released which permits the carousel to plumb itself regardless of the attitude of the frame means 12. When the carousel has plumbed itself, the brakes 34 and 38 are closed or locked onto their respective plates.

The hydraulic lift cylinder 44 is then extended until the lower end of the carousel frame 60 rests on the ground. The post drill assembly 92 is then pivoted to its drill position by means of the hydraulic cylinder 99 so that the upper end of the drill drive rod 106 is located directly beneath the fitting or sleeve 56. Hydraulic motor 102 is then actuated to cause drill 104 to be rotated. The rod of hydraulic cylinder 52 is then extended so that fitting 56 engages the drill drive rod 106 to force the rotating drill 104 downwardly to form a post hole in the ground, regardless if the ground is hard or frozen.

When the post hole has been formed, the rod of cylinder 52 is retracted. A spring (not shown) causes drill 104 to move upwardly to its raised position to pull the drill 104 from the post hole. The post drill assembly 92 is then pivotally moved from its drilling position to its rest or non-drilling position by the hydraulic cylinder. The movement of the post drill assembly 92 from its drilling position to its rest position causes the ratchet plate 82 to be rotated since the inner end of plate 96 is operatively secured thereto. The movement described above advances the ratchet plate one notch with the ratchet plate being held in that position by a ratchet pawl 130.

At this point, a fence post will be positioned in its pick-up position directly outwardly of the outer ends of the open clamp arms 114 and 116. The slide cylinder 110 is then actuated so that rod 112 is retracted into cylinder 110 which causes slide shaft 108 to be moved towards the fence post to be placed. The clamp arms 114 and 116 automatically clamp onto the fence post and push the fence post from its pick-up position outwardly to its placement position which is directly over the fence post hole just created by the drill 104.

The drill/install cylinder 52 is then extended so that fitting 56 engages the upper end of the post held in its placement position. The continued downward movement of the rod of cylinder 52 and fitting 56 causes the fence post to be pushed downwardly from the carousel into the post hole. The cylinder 52 is then retracted and the slide cylinder 110 is retracted. The lift cylinder 44 is then retracted to raise the carousel from the ground so that the installer 10 may be moved to the next post location. The plumbing, carousel lowering, drilling and installing procedures are then repeated until the job has been completed.

Thus it can be seen that the invention accomplishes at least all of its stated objectives.

We claim:

1. An electric fence post installer, comprising:

a wheeled frame having a forward end, a rearward end, and opposite sides;

said wheeled frame adapted to be pulled behind a prime mover;

a first upstanding support extending upwardly from said wheeled frame and having upper and lower ends;

a generally horizontally disposed boom arm mounted on the upper end of said first support and having inner and outer ends;

a carousel support secured to said outer end of said boom arm;

a carousel rotatably mounted, about a vertical axis, on said carousel support;

said carousel being adapted to have a plurality of vertically disposed and radially spaced-apart electric fence posts supported thereon;

an elongated, vertically disposed drill selectively vertically movably mounted on said carousel support and having upper and lower ends;

said drill being selectively rotatable;

said drill also being rotatable movably mounted on said carousel support between operative and inoperative positions;

said drill being selectively vertically movable so as to create a post hole opening in the ground adjacent said carousel support;

a first cylinder mounted on said carousel support;

said first cylinder adapted to vertically move said drill downwardly into the ground;

a fence post placement assembly mounted on said carousel;

said fence post placement assembly adapted to move a fence post from said carousel to a position over the post hole after said drill has created the post hole and has been moved to its inoperative position;

said first cylinder also adapted to drive the fence post, which is positioned over the post hole, downwardly thereinto.

2. The structure of claim 1 wherein said boom arm is pivotally movably mounted, between transport and operative positions, on said upper end of said first support.

3. The structure of claim of claim 2 wherein a brake is provided to selectively position said boom arm in its said transport and operative positions.

4. The structure of claim 1 wherein said carousel support being pivotally secured to said outer end of said boom assembly arm so that said carousel support will extend downwardly from said boom arm in a vertically disposed position regardless of the attitude of said boom arm.

5. The structure of claim 4 wherein brakes are provided to selectively lock said carousel support in its said vertically disposed position.

6. The structure of claim 1 wherein the fence posts are magnetically held on said carousel.

7. The structure of claim 1 wherein the fence posts have a generally V-shaped cross-section.

8. The structure of claim 1 wherein said carousel support is selectively vertically movably mounted on said outer end of said boom arm.

9. The structure of claim 1 wherein said carousel is rotatably indexed when said drill is moved from its said operative position to its said inoperative position.

10. The structure of claim 9 wherein the rotatable indexing of said carousel causes a fence post to be placed into position for movement over the post hole.

11. The structure of claim 1 wherein said carousel support includes a central column having a post placement assembly mounted thereon.

12. The structure of claim 11 wherein said post placement assembly is movable from an inoperative position to an operative position.

13. The structure of claim 12 wherein said post placement assembly includes a post clamping mechanism which clamps onto a fence post to move the fence post from said carousel to a position over the post hole.

14. The structure of claim 1 wherein said carousel includes at least upper and lower disc-shaped plates having radially spaced chuck openings formed in the peripheries thereof and wherein magnets are mounted on said disc-shaped plates at said chuck openings to yieldably maintain the fence posts in said chuck openings.

15. The structure of claim 1 wherein a stalk knocker assembly is mounted on said wheeled frame means forwardly of said carousel.

16. The structure of claim 1 wherein a wire reel is positioned in said wheeled frame means.

17. The structure of claim 1 wherein a storage box is positioned on said wheeled frame means.

18. The structure of claim 1 wherein said drill is mounted on a drill guide secured to said carousel support.

19. The structure of claim 1 wherein a hydraulic motor is connected to said drill to rotate the same for drilling purposes.

* * * * *